US009926091B2

(12) United States Patent
Schilling

(10) Patent No.: US 9,926,091 B2
(45) Date of Patent: Mar. 27, 2018

(54) SHRINK TUNNEL FOR APPLYING SHRINK FILMS, METHOD FOR OPERATING OR CONTROLLING A SHRINK TUNNEL, AND PRODUCTION SYSTEM HAVING A SHRINK TUNNEL

(75) Inventor: Christian Schilling, Diemelsee (DE)

(73) Assignee: KHS GmbH, Dortmund (DE)

( * ) Notice: Subject to any disclaimer, the term of this patent is extended or adjusted under 35 U.S.C. 154(b) by 870 days.

(21) Appl. No.: 13/635,022

(22) PCT Filed: Jan. 25, 2011

(86) PCT No.: PCT/EP2011/000284

§ 371 (c)(1),
(2), (4) Date: Sep. 14, 2012

(87) PCT Pub. No.: WO2011/113506

PCT Pub. Date: Sep. 22, 2011

(65) Prior Publication Data

US 2013/0000256 A1 Jan. 3, 2013

(30) Foreign Application Priority Data

Mar. 16, 2010 (DE) ..... 10 2010 011 640

(51) Int. Cl.
*B65B 53/02* (2006.01)
*B65B 53/06* (2006.01)
(Continued)

(52) U.S. Cl.
CPC ..... *B65B 53/063* (2013.01); *F27B 9/10* (2013.01); *F27B 9/40* (2013.01); *B65B 2220/24* (2013.01);
(Continued)

(58) Field of Classification Search
None
See application file for complete search history.

(56) References Cited

U.S. PATENT DOCUMENTS 3,399,506 A * 9/1968 Howe, Jr. ..... 53/442
3,591,767 A * 7/1971 Mudie ..... B65B 53/02 219/244
(Continued)

FOREIGN PATENT DOCUMENTS

CA 2783217 5/2007
DE 199 20 057 11/2000
(Continued)

OTHER PUBLICATIONS

Napravnik et al., EP2687447A1, Jan. 2014, partial machine translation of Description.*
(Continued)

*Primary Examiner* — Joseph M Pelham
(74) *Attorney, Agent, or Firm* — Occhiuti & Rohlicek LLP

(57) ABSTRACT

An apparatus comprises a shrink tunnel for use in a production system for the production of packaging units from packaging materials filled with a product and having shrink film shrunk thereon, the shrink tunnel comprising a tunnel zone, heating means for application of heat to shrink the shrink film onto packaging units moved through the tunnel zone, the tunnel zone being maintained at a tunnel temperature equal to a target operating temperature, wherein the tunnel has an operating mode and a standby mode, wherein heat output during the standby mode is less than heat output during the operating mode, and wherein the standby mode is triggered by at least one of a time control and a signal control.

30 Claims, 1 Drawing Sheet

(51) Int. Cl.

| | |
|---|---|
| ***F27B 9/10*** | (2006.01) |
| ***F27B 9/40*** | (2006.01) |
| ***F27D 21/00*** | (2006.01) |
| *F27D 19/00* | (2006.01) |

(52) U.S. Cl.
CPC ..... *F27D 21/00* (2013.01); *F27D 2019/0003* (2013.01); *F27D 2019/0059* (2013.01); *F27D 2019/0087* (2013.01)

(56) References Cited

U.S. PATENT DOCUMENTS

| | | | | |
|---|---|---|---|---|
| 4,555,895 | A * | 12/1985 | Torre | 53/557 |
| 4,664,923 | A | 5/1987 | Wagner et al. | |
| 5,031,298 | A * | 7/1991 | Fresnel | 29/447 |
| 5,197,375 | A * | 3/1993 | Rosenbrock | A21B 1/40 219/388 |
| 5,371,999 | A * | 12/1994 | Hansen | B65B 9/06 53/374.6 |
| 5,483,230 | A * | 1/1996 | Mueller | H03K 17/94 340/3.1 |
| 5,850,370 | A * | 12/1998 | Stringer | G01B 11/00 367/128 |
| 6,701,696 | B1 * | 3/2004 | Torre | 53/557 |
| 7,363,728 | B1 | 4/2008 | McNeil et al. | |
| 8,087,407 | B2 * | 1/2012 | Wiker et al. | 126/21 A |
| 9,073,251 | B2 * | 7/2015 | Hahn | B29C 49/42 |
| 2004/0083687 | A1 | 5/2004 | Christman et al. | |
| 2004/0168411 | A1 * | 9/2004 | Christman et al. | 53/557 |
| 2004/0216425 | A1 * | 11/2004 | Morton | B65B 11/58 53/397 |
| 2005/0246918 | A1 * | 11/2005 | Tanahashi | B01D 53/06 34/80 |
| 2007/0012307 | A1 * | 1/2007 | Wiker et al. | 126/21 A |
| 2008/0148691 | A1 * | 6/2008 | Elsperger | B65B 53/066 53/442 |
| 2008/0209753 | A1 * | 9/2008 | Smith | F26B 17/08 34/214 |
| 2009/0075224 | A1 * | 3/2009 | Wiker et al. | 432/8 |
| 2009/0077933 | A1 * | 3/2009 | Backhaus | B65G 47/846 53/561 |
| 2010/0030375 | A1 * | 2/2010 | Hartmann | G05B 19/4182 700/230 |
| 2010/0032077 | A1 * | 2/2010 | Uetsuki | B65B 53/063 156/86 |
| 2010/0058715 | A1 * | 3/2010 | Schilling | B65B 53/063 53/442 |
| 2010/0082149 | A1 * | 4/2010 | Till | B67C 3/007 700/214 |
| 2010/0211201 | A1 * | 8/2010 | Papenfort | G05B 19/41845 700/95 |
| 2010/0212140 | A1 * | 8/2010 | Jendrichowski | B23K 37/04 29/525.06 |
| 2010/0269322 | A1 * | 10/2010 | Jendrichowski | B23K 37/0443 29/428 |
| 2011/0061347 | A1 * | 3/2011 | Stoiber | B65C 9/40 53/558 |
| 2011/0260372 | A1 * | 10/2011 | Hahn | B29C 49/42 264/500 |
| 2012/0073558 | A1 * | 3/2012 | Wiker et al. | 126/21 A |
| 2014/0298100 | A1 * | 10/2014 | Grimm | B29C 49/78 714/37 |
| 2014/0360381 | A1 * | 12/2014 | Wiker et al. | 99/331 |
| 2015/0264319 | A1 * | 9/2015 | Wood | H04N 7/181 348/125 |

FOREIGN PATENT DOCUMENTS

| | | | |
|---|---|---|---|
| EP | 2687447 | A1 * | 1/2014 |
| WO | WO01/22823 | | 4/2001 |

OTHER PUBLICATIONS

Ocme—Update Shrink-wrap packers ="Green engineering to reduce costs and respect the environment". Sep. 2009, p. 1-4.
Drinktec 2009—OCME—"Filling, packaging, palletizing and handling systems" May 3, 2013, p. 1-2.
Ocme—"Energy Saving Kit on shrinking tunnels: the new test" May 3, 2013, p. 1.
Vega—"Sant'Anna—sorgente Rebruant" May 3, 2013, p. 1.
Ferret—"HBM Packaging & Plastics Technologies release new OCME low-energy shrink-wrapping tunnel" Feb. 28, 2013, p. 1-2.

* cited by examiner

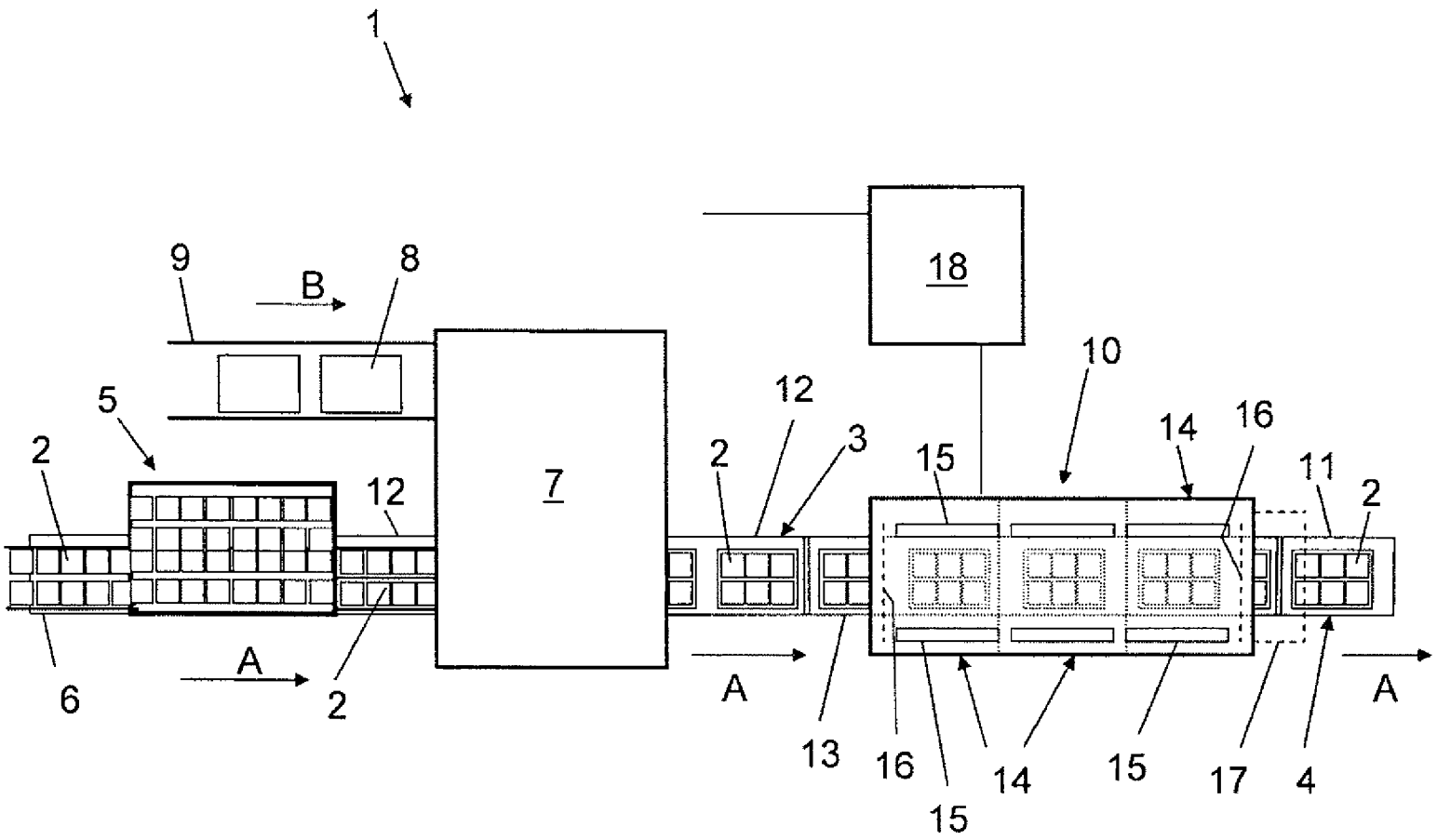
1
2
3
4
5
6
7
8
9
10
11
12
13
14
15
16
17
18
A
B

SHRINK TUNNEL FOR APPLYING SHRINK FILMS, METHOD FOR OPERATING OR CONTROLLING A SHRINK TUNNEL, AND PRODUCTION SYSTEM HAVING A SHRINK TUNNEL

CROSS REFERENCE TO RELATED APPLICATION

This application is the national phase filing of international application no. PCT/EP2011/000284, filed Jan. 25, 2011, which claims priority to German application no. 10 2010 011 640.8, filed Mar. 16, 2010. The contents of the aforementioned applications are incorporated herein in their entirety.

FIELD OF DISCLOSURE

The invention relates to a shrink tunnel for applying shrink films on packaging units or containers to a method for operating or controlling a shrink tunnel, and to a production system with a shrink tunnel.

BACKGROUND

To ensure shrink-wrapping of the necessary quality, it is usual to have a shrink tunnel with consecutive heating or tunnel zones each with its own heating system. The heating systems are typically electric or gas-powered heating systems that blow hot air. These zones follow each other in the direction of transport of packaging units or containers through the shrink tunnel.

Each tunnel zone is kept at a target operating temperature required to shrink on the shrink film. This temperature is typically in a range between 195° C. and 210° C., preferably around 200° C. The heating systems maintain these temperatures even when no packages or package groups are being moved through the shrink tunnel. These interruptions in the flow of packages can arise, for example, as a result of malfunctions in the system components or machines before or after the shrink tunnel.

During such an interruption, no new packages are entering the shrink tunnel. This means that the cost of maintaining the desired temperature becomes lower than it would be if packages were in fact entering the shrink tunnel. However, although there is an energy savings associated with having no packages enter the tunnel, the net effect is still wasted gas and excess carbon dioxide emission.

SUMMARY

In a further development of the invention, the shrink tunnel and/or the method for its control are beneficially developed such that the tunnel temperature in the shrink tunnel and/or in the at least one tunnel zone is set or controlled above the output of the heating means generating the tunnel temperature such that during the normal operating mode the tunnel temperature reaches the target operating temperature, for example a target operating temperature in the range between 190 and 210° C., preferably a target operating temperature of 200° C. and in standby mode the tunnel temperature in at least one tunnel zone is lowered by a temperature amount, for example by a temperature amount of 50° C. to 80° C. from the target operating temperature to a reduced tunnel temperature, and/or that in several of the consecutive tunnel zones in the direction of transport, to which in each case specific heating means are allocated, they are controlled or set independently for switching the operating modes, this being preferably depending on the control or adjustment parameters set or stored in the control unit, and/or that the target operating temperature and/or the reduced tunnel temperature are adjustable and/or are stored in the control unit as control or adjustment parameters, and/or that the heating means of the at least one tunnel zone are controlled or set between a heat output corresponding to a base load and a maximum heat output, for example between a heat output (base load) of 10 KW to 14 KW and a heat output of 46 KW-50 KW, and/or that the standby mode in the presence of at least one signal indicating an operating interruption, for example a signal delivered by a superordinate control unit of the production system (line signal) and/or triggered with a time delay, for example with a time delay in the range of 1 to 2 minutes, and/or that the return of the shrink tunnel to normal operating mode occurs after the disappearance of the error message, in particular by increasing the heat output or the increase of the tunnel temperature to the target operating temperature, and/or that after the triggering of the standby mode, a reduction in the transport speed of a conveyor on the shrink tunnel side, for example a reduction in the transport speed to 20% to 40% of the transport speed of the normal operating mode and/or the switching-off of a cooling system in the transport element on the shrink tunnel side and/or a cooling system which serves to cool the packaging units after the shrinking-on of the shrink film, and/or a switching-off of the blowers of the heating means occurs, and/or that when an error message disappears or the shrink tunnel is reset to normal operating mode, the tunnel temperature is reset to the target operating temperature, and/or that when an error message disappears or the shrink tunnel is reset to normal operating mode, the blowers of the heating means are switched on, and/or that when an error message disappears or the shrink tunnel is reset to normal operating mode and when a first temperature threshold of the tunnel temperature below the target operating temperature is reached, the transport speed of the conveyor on the shrink tunnel side (13) is increased again, this being for example at a first temperature threshold lying around 5% below the temperature threshold, and/or that when an error message disappears or the shrink tunnel is reset to normal operating mode and when a first temperature threshold of the tunnel temperature below the target operating temperature is reached, a cooling system of this transport system is switched on, for example at a first temperature threshold lying around 5% below the temperature threshold, and/or that when an error message disappears or the shrink tunnel is reset to normal operating mode and when a second threshold closer to the target operating temperature is reached, lying for example at 2% below the target operating temperature, a signal triggering production approval is generated and/or the cooling system for the packaging units or containers is switched on, whereby the aforesaid characteristics can be used individually or in any combination.

Further developments, benefits and application possibilities of the invention arise from the following description of examples of embodiments and from the FIGURES. In this regard, all characteristics described and/or illustrated individually or in any combination are categorically the subject of the invention, regardless of their inclusion in the claims or reference to them. The content of the claims is also an integral part of the description.

BRIEF DESCRIPTION OF THE FIGURE

The invention is explained in more detail below using FIG. 1, which shows a simplified functional representation of a production system.

DETAILED DESCRIPTION

FIG. 1 shows a production system 1 for forming shrink-wrapped package units 4 from packages 2 that have been filled with a product, such as a beverage. Typical packages 2 include bottles, cans, and similar containers that have been filled with the product, sealed, and labeled.

The illustrated production system 1 receives packages 2 from a first conveyor 6 and moves them along a first transport direction A. Along the way, each package 2 encounters a buffer 5, a packaging machine 7, and a shrink tunnel 10.

The buffer 5 receives packages 2 from the first conveyor 6 and provides interim storage for the packages 2 before placing them on a second conveyor 12 that takes them to the packaging machine 7.

The packaging machine 7 receives packages 2 from the second conveyor 12. In addition, the packaging machine 7 receives packaging elements 8 moving along a third conveyor 9 in a second transport direction B. Examples of these packaging elements 8 include carton-type packaging elements, plates, or trays.

The packaging machine 7 combines the packaging elements 8 and packages 2 to form the package groups 3 that are ultimately to become shrink-wrapped package units 4. Each package group 3 has a specified number of packages 2 in a specified arrangement. For example, in the illustrated embodiment, the package group 3 has two rows of packages 2 and three columns of packages 2. Each row extends along the first transport direction A. The columns are perpendicular to the rows.

The packaging machine 7 also covers each package group 3 with a loose piece of shrink film in such a way that overlapping ends of the shrink film are on the underside of the package group 3 or on the underside of the packaging element 8. From the packaging machine 7, the second conveyor 12 brings the packages 2, now organized into package groups 3, to the entrance to the shrink tunnel 10.

A cooling installation, such as a cooling air blower, cools a portion of the second conveyor 12 outside and upstream of the shrink tunnel 10. Each package group 3 passes onto the cooled portion of the second conveyor 12 on its way to the shrink tunnel 10.

Just before the shrink tunnel's entrance, the second conveyor 12 ends. At this point, package groups 3 move onto the shrink tunnel's own independently controllable fourth conveyor 13. The fourth conveyor 13 carries the package groups 3 all the way through the shrink tunnel 10 until they reach a fifth conveyor 11.

The fifth conveyor 11 then takes the package groups 3, which by now have been transformed into fully shrink-wrapped package units 4, to a further use or treatment, such as a pallet-loader. In a typical embodiment, the fourth conveyor 13 is a conveyor belt, such as a wire link conveyor or flat-top chain conveyor.

Just after the shrink tunnel's exit is a cooling zone 17. A cooling air blower at the cooling zone 17 cools the shrink-wrapped package units 4.

The shrink tunnel 10 has three consecutive heating zones 14 that are arranged sequentially along the transport direction A. Each zone 14 has its own heater 15, with its own hot-air generator and blower. These ensure that, in normal undisturbed operation, even when package groups 3 move through the shrink tunnel 10 in close succession, the shrink tunnel 10 properly shrinks the shrink-wrap. Lamellar curtains 16 at the entrance and exit of the shrink tunnel 10 suppress heat loss from the shrink tunnel 10.

The production system 1 operates in either production mode or standby mode.

In production mode, each heater 15 outputs an amount of heat that is needed to maintain its corresponding zone 14 at a production temperature. A typical rate of heat output is 10-15 kilowatts, although in some cases, the heaters 15 output as much as 45-50 kilowatts. The production temperature is sufficient for shrinking the shrink-film to an extent required to achieve a good quality shrink-wrap. A typical production temperature is typically around 200° C.

In addition, in production mode, the second conveyor 12 and the fourth conveyor 13 both move at a production speed. In a typical installation, the production speed is well above eight meters per minute.

Finally, in the production mode, the blower that provides cooling air for the cooling installation 17 is switched on.

When an interruption occurs, the production system 1 transitions from production mode into standby mode. Examples of operating interruptions that would trigger standby mode include having the number of packages 2 in the buffer 5 fall below some specified quantity, or having a package jam either before and/or after the shrink tunnel 10. Once the interruption is remedied, the production system 1 reverts to its production mode.

An electronic control unit 18 controls the various components of the shrink tunnel 10 that change operation between the two operating modes. The electronic control unit 18 is a smart control unit that is allocated to the shrink tunnel 10. In particular, the shrink tunnel's electronic control unit 18 controls the heater 15, thereby controlling the tunnel's temperature at any time.

A bus connects the electronic control unit 18 to further control units or to a central or overriding system control unit, referred to herein as a superordinate controller.

In response to error messages, the superordinate controller provides instructions to the shrink tunnel's electronic control unit 18. These error messages can originate either upstream from the shrink tunnel 10 or downstream from the shrink tunnel 10. Examples of error messages that originate from upstream of the shrink tunnel 10 include: "insufficient material in buffer" "insufficient packages in packaging machine," and/or "Minimum product." Examples of error messages originating downstream of the shrink tunnel 10 include "external bottleneck," and/or "no pallets."

The instructions from the superordinate controller cause the shrink tunnel's electronic control unit 18 to transition the shrink tunnel 10 from production mode to standby mode.

In standby mode, the packaging machine 7 is turned off so that no new packages begin the journey towards the shrink tunnel 10.

Additionally, the shrink tunnel's electronic controller 18 switches off one or more heating elements at each heating zone 14, thereby lowering that zone's temperature by $\Delta T$ from the operating temperature to a standby temperature, Typically, $\Delta T$ lies in the range between 50° C. and 80° C. Preferably, $\Delta T$ is around 50° C. However, the control unit 18 can also adapt $\Delta T$ to actual production conditions if necessary. In addition, the value of $\Delta T$ can differ from one heating zone 14 to the next.

Operating in standby mode also includes reducing the transport speed of the fourth conveyor 13 to a standby transport speed that is between 20% and 40% of the production speed that is used during production mode.

Operating in standby mode also includes switching off the cooling system in the cooling zone 17. For those embodiments in which a heating zone 14 has two or more electrically driven blowers, operating in standby mode also includes switching off one of these blowers.

Standby mode does not begin immediately upon receiving an error message. If it did, then any package groups 3 that happen to already be in the shrink tunnel 10 at the time the error message is received might find themselves improperly shrink-wrapped. Instead, there is a first time-delay between receiving an error message and transitioning into standby mode. The length of this first time-delay is selected to be long enough for any package groups 3 that have already begin the shrink-wrapping process to complete the process. In a typical embodiment, the first time-delay is between one and two minutes.

After the error message has been cleared, the shrink tunnel 10 returns to production mode. However, it does not do so immediately. Instead, it does so after a second time-delay. This second time-delay arises as a result of the time needed to re-heat the shrink tunnel 10 to its production temperature. In a typical embodiment, this second time-delay is between two and three minutes. It is only after this second time-delay that the packaging machine 7 is turned back on.

Preferably, the packaging machine 7 and the second conveyor 12 are switched back on only when the heating zones 14 have all reached the production temperature or at least a temperature that is very close to the production temperature. The packaging machine 7 and preferably also the second conveyor 12 are then triggered to switch on in response to a signal from the electronic control unit 18.

Operating in standby mode during an interruption results in considerable saving of heat energy and, in the case of a gas-powered shrink tunnel 10, a considerable reduction in waste gas emissions, and in particular, $CO_2$ emissions.

In a conventional system, even during operating interruptions, i.e. where no package groups 3 are moved through the shrink tunnel, the shrink tunnel continues to operate at its production temperature, for example at around 200° C. Since no packages are entering the shrink tunnel, the actual rate at which heat energy must enter the shrink tunnel to maintain the production temperature is reduced. In fact, the rate at which heat energy must enter the shrink tunnel to maintain the operating temperature when no packages are moving through the shrink tunnel is only about 40% to 50% of what would be required to maintain that production temperature when the shrink tunnel is actually being used to shrink-wrap packages. For conventional shrink tunnels, the required rate at which heat enters the shrink tunnel is in the range of 40 kilowatts to 45 kilowatts.

Measurements of the power required to maintain particular temperatures have been carried out. In these measurements, the test shrink tunnel had a production temperature of 200° C. When the temperature was reduced to a standby temperature of 150° C., only 5.4 kilowatts was needed to maintain that temperature. When the standby temperature was set to 120° C., only 4.6 kilowatts was needed to maintain that temperature. The time required to fall from the operating temperature to the standby temperature was between eight and ten minutes.

Measurements were also made to determine the time required to heat the shrink tunnel back to production temperature from the standby temperature. When the standby temperature was 150° C., it took 2.5 minutes to heat the shrink tunnel back up to the production temperature. When the standby temperature was 120° C., it took 4 minutes to heat the shrink tunnel back to its operating temperature.

Even taking account of the time taken after the triggering of standby mode for the temperature to fall from the production temperature to the standby temperature, there is a considerable energy-saving potential from switching into standby mode. Thus, for example, the energy saving that arises from switching into standby mode for a one-minute disruption or interruption in operation lies between 1.44 kilowatt-hours and 5.76 kilowatt-hours. Switching into standby mode for a 30-minute disruption or interruption saves around 18 kilowatt-hours. This includes energy needed to re-heat the shrink tunnel at the end of the operating interruption.

A considerable energy saving results furthermore from switching-off of the cooling system or cooling blower for the fourth conveyor 13 and the cooling zone 17, and also from switching-off of at least one hot-air blower in each heating zone 14, each of which demands around 3 kilowatts.

After the error messages have been cleared, the production system 1 returns to production mode. The return to production mode is marked by a production approval.

The process of returning to production mode includes five stages.

The first stage is to raise the temperatures in the heating zones 14 back to the production temperature set within the electronic control unit 18. This includes switching on all heaters 15 and hot-air blowers.

The second stage is to raise the transport speed of the fourth conveyor 13 back to the production speed.

The third stage is to switch on the conveyor belt cooling system once the heating zones 14 have all reached a temperature threshold during re-heating. This threshold is set to be in the range of between 95% of the production temperature and 93% of the production temperature. Thus, for a production temperature of 200° C., the 95% threshold occurs when the temperature has climbed to 190° C.

The fourth stage is to turn on the packaging machine 7.

The fifth stage is to switch on the cooling system for the package units 4.

Once all these stages have been carried out and the temperature in all the heating zones 14 is within 97%-98% of the production temperature, a production approval issues.

The electronic control unit 18 includes a memory that stores the operating parameters for use during production mode and standby parameters for use during standby mode. These include the production temperature, the standby temperature, the first and second time delays, the production speed for transport, and the standby speed for transport. These parameters can all be adjusted at the electronic control unit 18.

In a preferred embodiment of the invention, there are two separate standby modes: a planned standby mode and an unplanned standby mode. The unplanned standby mode is that which has been described above. It occurs in response to unplanned interruptions. The planned standby mode occurs when an interruption is planned. The planned standby mode is thus triggered by events that differ from those events that trigger the unplanned standby mode. In addition, the planned standby mode has operating parameters that differ from those of the unplanned standby mode.

The planned standby mode is used for planned production interruptions, for example those that occur with a known frequency, those that last for a longer duration, and those that have a planned start and end time. These correspond, in some cases, to scheduled production breaks.

The planned standby mode is characterized by standby temperatures that are even lower than those used for unplanned standby mode. In addition, the return to production mode, and in particular, the re-heating of the zones 14, can be optimized since the time at which production mode is to begin is already known in advance.

The invention was described above using an example of an embodiment. It is clear that numerous modifications and variations are possible without thereby departing from the invention idea on which the invention is based.

The invention claimed is:

1. An apparatus for use in a production facility for producing shrink-wrapped packaging units made from packaging containers filled with a product, said apparatus comprising a controller, and a shrink tunnel, wherein said shrink tunnel comprises a tunnel zone and a heater, wherein said tunnel zone has a tunnel-zone temperature that varies in response to operation of said heater, wherein, in response to an instruction from said controller, said apparatus transitions between operating in normal mode and operating in standby mode, wherein, when said apparatus is operating in said normal mode, said tunnel-zone temperature is equal to a normal temperature, wherein, when said apparatus is operating in said standby mode, said tunnel-zone temperature is equal to a standby temperature, wherein said standby temperature is less than said normal temperature, wherein, when said apparatus is operating in said normal mode, said heater has a normal-mode heat-output, wherein, when said apparatus is operating in said standby mode, said heater has a standby-mode heat-output, wherein said standby-mode heat-output is less than said normal-mode heat-output, wherein, when said apparatus is operating in said normal mode, said normal-mode heat-output maintains said tunnel-zone temperature at said normal temperature, wherein, when said apparatus is operating in said normal mode, containers that are passed through said shrink tunnel are exposed to said normal temperature, wherein said controller causes said apparatus to transition into operating in said standby mode in response to receiving first instructions from a superordinate control unit of said production facility, said first instructions having been sent in response to receipt of a first error message, said first error message having originated upstream from said shrink tunnel and indicating a type of malfunction of said production facility upstream of said shrink tunnel, wherein said controller causes said apparatus to transition into operating in said standby mode in response to receiving second instructions from a superordinate control unit of said production facility, said second instructions having been sent in response to receipt of a second error message that originated downstream from the shrink tunnel, wherein said second error message is an error message that indicates a type of malfunction of said production facility of said production facility downstream of said shrink tunnel, and wherein said controller causes said shrink tunnel to operate in normal mode in the absence of receiving an error message.

2. The apparatus of claim 1, further comprising a conveyor that passes through said shrink tunnel, wherein, when said apparatus is operating in said normal mode, said conveyor operates with a conveyor velocity set to a normal velocity, wherein, when said apparatus is operating in said standby mode, said conveyor operates with said conveyor velocity set to a standby velocity, wherein said standby velocity is less than said normal velocity, wherein said controller is configured to cause said apparatus to resume operating in normal mode after having caused said apparatus to transition from operating in said normal mode to operating in said standby mode, wherein, as part of causing said apparatus to transition from operating in said normal mode to operating in said standby mode, said controller causes said tunnel-zone temperature to begin falling toward said standby temperature, wherein, as part of causing said apparatus to transition from operating in said normal mode to operating in said standby mode, said controller activates fans associated with said heater, wherein, in response to determining that said tunnel-zone temperature has surpassed a threshold temperature that is between said operating temperature and said standby temperature, said controller causes said carrier conveyor velocity to climb from said standby velocity to said operating velocity.

3. The apparatus of claim 1, wherein said controller is configured to cause said normal temperature to be between 190° C. and 210° C., and wherein said controller is configured to cause said standby temperature to be between 110° C. and 160° C.

4. The apparatus of claim 1, wherein said controller is configured to cause said normal temperature to be 200° C., and wherein said controller is configured to cause said standby temperature to be between 150° C. and 120° C.

5. The apparatus of claim 1, wherein said tunnel zone is one of a plurality of tunnel zones disposed along a transport direction along which said packaging containers filled with said product are conveyed, wherein each of said tunnel zones comprises a corresponding heater that can be controlled independently of heaters in other tunnel zones, wherein said controller is configured to control said heaters based at least in part on parameters stored in said controller.

6. The apparatus of claim 1, wherein said normal-mode heat output and said standby-mode heat output are between a base value and a maximum value, wherein said base value is between 10 kW and 14 kW and wherein said maximum value is between 46 kW and 50 kW.

7. The apparatus of claim 1, wherein, in response to receiving one of said first and second instructions, said controller causes said apparatus to transition into operating in said standby mode after waiting for a predetermined time.

8. The apparatus of claim 1, wherein, in response to receiving one of said first and second instructions, said controller causes said apparatus to transition into operating in said standby mode after waiting between one and two minutes.

9. The apparatus of claim 1, further comprising a cooling zone for cooling shrink-wrapped packaging units that emerge from said tunnel, wherein when said controller causes said apparatus to transition into operating in said standby mode, said controller deactivates said cooling zone.

10. The apparatus of claim 1, further comprising a fan associated with said heater, wherein when said controller causes said apparatus to transition into operating in said standby mode, said controller deactivates said fan.

11. The apparatus of claim 1, further comprising a cooling zone for cooling shrink-wrapped packaging units that emerge from said tunnel, wherein when said controller causes said apparatus to transition into operating in said normal mode, said controller activates said cooling zone when said tunnel-zone temperature surpasses a threshold temperature that is between said normal-operating temperature and said standby temperature.

12. The apparatus of claim 1, further comprising a packaging machine, wherein said shrink tunnel is downstream of said packaging machine, wherein said packaging machine is configured to form a package group out of a plurality of packages and to place shrink-wrap loosely over said package group prior to dispatching said package group to said shrink tunnel.

13. The apparatus of claim 12, further comprising a buffer that provides interim storage for packaging containers prior to sending said packages to said packaging machine.

14. The apparatus of claim 1, further comprising a bus that connects said controller to said superordinate control unit.

15. The apparatus of claim 1, further comprising a conveyor that passes through said shrink tunnel, wherein, when said apparatus is operating in said normal mode, said conveyor operates with a conveyor velocity set to a normal velocity, wherein, when said apparatus is operating in said standby mode, said conveyor operates with said conveyor velocity set to a standby velocity, wherein said standby velocity is less than said normal velocity, wherein said controller is configured to cause said apparatus to resume operating in normal mode after having caused said apparatus to transition from operating in said normal mode to operating in said standby mode, wherein, as part of causing said apparatus to resume operating in normal mode, said controller causes said tunnel-zone temperature to begin climbing toward said normal temperature, wherein, as part of causing said apparatus to transition from operating in said normal mode to operating in said standby mode, said controller activates fans associated with said heater, wherein, in response to determining that said tunnel-zone temperature has surpassed a threshold temperature that is between said operating temperature and said standby temperature, said controller produces a signal indicating initiation of production release.

16. An apparatus use in a production facility for producing shrink-wrapped packaging units made from packaging containers filled with a product, said apparatus comprising a controller, a shrink tunnel, and a conveyor that passes through said shrink tunnel, wherein said shrink tunnel comprises a tunnel zone and a heater, wherein said tunnel zone has a tunnel-zone temperature, wherein, in response to an instruction from said controller, said apparatus transitions between operating in normal mode and operating in standby mode, wherein, when said apparatus is operating in normal mode, said heater has a normal heat-output, wherein, when said apparatus is operating in standby mode, said heater has a standby heat-output, wherein said standby heat-output is less than said normal heat-output, wherein said normal heat-output maintains said tunnel-zone temperature at a normal temperature, wherein said standby heat-output maintains said tunnel-zone temperature at a standby temperature, wherein, when said apparatus is operating in said normal mode, passing containers through said tunnel exposes said containers to said normal temperature, wherein, when said apparatus is operating in said normal mode, said conveyor operates with a normal velocity, wherein, when said apparatus is operating in said standby mode, said conveyor operates with a standby velocity, wherein said standby velocity is less than said normal velocity, wherein, as part of causing said apparatus to resume operating in normal mode following interruption in operation of said production facility, said controller is configured to reset said tunnel temperature to said normal temperature, wherein, as part of said resetting, said controller is further configured to cause said conveyor velocity to climb to said normal velocity and to produce a signal indicating production approval while said shrink tunnel is not yet hot enough to shrink wrap.

17. The apparatus of claim 16, wherein said controller causes said apparatus to transition from operating in said normal mode into operating in said standby mode in response to receiving, from a superordinate control unit of said production facility, first instructions, said first instructions having been sent in response to receipt of a first error message, said first error message having originated downstream from said shrink tunnel and indicating a type of malfunction of said production facility that occurs downstream of said shrink tunnel.

18. The apparatus of claim 16, wherein said standby velocity is equal to between 20% and 30% of said normal velocity.

19. The apparatus of claim 16, wherein said controller is further configured to activate a cooling installation of said conveyor after said conveyor velocity has begun climbing, and to activate a cooling installation at a cooling zone at which shrink-wrapped packages emerging from said shrink tunnel are cooled, and wherein producing said signal indicative of production release occurs after having activated said cooling installation.

20. The apparatus of claim 16, wherein, when said controller causes said apparatus to transition into operating in normal mode, said controller causes execution of a first action when said tunnel-zone temperature surpasses a first threshold and a second action when said tunnel-zone temperature surpasses a second threshold that is greater than said first threshold.

21. The apparatus of claim 20, wherein said first threshold is between 93% and 95% of said normal temperature and said second threshold is between 97% and 98% of said normal temperature.

22. The apparatus of claim 16, wherein said conveyor comprises a wire link conveyor.

23. The apparatus of claim 16, wherein said conveyor comprises a flat-top chain conveyor.

24. A method comprising controlling an apparatus for producing shrink-wrapped packaging units made from packaging containers filled with a product, said apparatus comprising a shrink tunnel having a tunnel zone having a tunnel-zone temperature, and a heater having a standby output and a normal output, said apparatus being operable to transition between operating in normal mode, in which said tunnel-zone temperature is equal to a normal temperature, and operating in standby mode, in which said tunnel-zone temperature is equal to a standby temperature that is lower than said normal temperature, wherein controlling said apparatus comprises, in the absence of receiving a message from said superordinate control unit of said production facility, causing said apparatus to operate in normal mode, receiving, from said superordinate control unit, first instructions, said first instructions having been sent in response to receipt of a first error message, said first error message having originated upstream from said shrink tunnel and indicating a type of malfunction of said production facility upstream of said shrink tunnel, in response to said first error message, causing said apparatus to operate in said standby mode, receiving, from said superordinate control unit, second instructions, said second instructions having been sent in response to receipt of a second error message that originated downstream from the shrink tunnel, wherein said second error message is an error message that indicates a type of malfunction of said production facility downstream of said shrink tunnel, and, in response to said second error signal, causing said apparatus to operate in standby mode.

25. The method of claim 24, further comprising causing said operating temperature to be between 190 and 210° C., and causing said standby temperature to be between 50° C. and 80° C. less than said operating temperature.

26. The method of claim 24, further comprising causing said heater to have a base heat output of between 10 kW and 14 kW and a maximum heat output of between 46 kW and 50 kW.

27. The method of claim 24, wherein causing said apparatus to operate in said standby mode comprises detecting one of said first and second instructions and, after a time delay, initiating said transition into standby mode.

28. A method for controlling an apparatus for producing shrink-wrapped packaging units made from packaging containers filled with a product, said apparatus comprising a shrink tunnel having a tunnel zone having a tunnel-zone temperature, a heater having a standby output and a normal output, and a conveyor leading into said shrink tunnel for transporting at a conveyor velocity, said apparatus being operable to transition between operating in normal mode, in which said tunnel-zone temperature is equal to a normal temperature and said conveyor velocity is equal to a normal velocity, and operating in standby mode, in which said tunnel-zone temperature is equal to a standby temperature that is lower than said normal temperature, and said conveyor velocity is equal to a standby velocity that is lower than said normal velocity, said method comprising resuming operating in normal mode following interruption in operation of said production facility, wherein resuming operation in normal mode comprises resetting said tunnel temperature to said normal temperature, and, before said shrink tunnel has become hot enough to shrink wrap, causing said conveyor velocity to climb to said normal velocity, and producing a signal initiating production approval.

29. The method of claim 28, further comprising causing said apparatus to operate in standby mode, wherein causing said apparatus to operate in standby mode comprises reducing said conveyor velocity to between 20% and 40% of said normal velocity, disabling a cooling system of said conveyor, disabling a cooling system used for cooling said packaging units, and disconnecting heater fans within said shrink tunnel.

30. The method of claim 28, wherein a first threshold temperature is between 5% and 7% below said normal temperature, wherein a second threshold temperature is between 2% and 5% below said normal temperature, wherein resuming operating in normal mode following interruption in operation of said production facility comprises increasing said conveyor velocity and starting a cooling system after said tunnel temperature has passed said first threshold temperature, and activating said cooling system and sending a signal initiating a production release when said tunnel temperature reaches said second threshold.

* * * * *